US012134509B2

(12) United States Patent
Kim et al.

(10) Patent No.: US 12,134,509 B2
(45) Date of Patent: Nov. 5, 2024

(54) CONTAINER FOR RETORT FOOD

(71) Applicant: CJ CHEILJEDANG CORPORATION, Seoul (KR)

(72) Inventors: Ki Pyo Kim, Seoul (KR); Yong Hwan Kim, Seoul (KR); Kyoung Sik Cho, Seoul (KR); Kwang Soo Park, Gwacheon-si (KR); Byung Kook Lee, Seoul (KR)

(73) Assignee: CJ CHEILJEDANG CORPORATION, Seoul (KR)

( * ) Notice: Subject to any disclaimer, the term of this patent is extended or adjusted under 35 U.S.C. 154(b) by 540 days.

(21) Appl. No.: 17/425,612

(22) PCT Filed: Jan. 23, 2020

(86) PCT No.: PCT/KR2020/001210
§ 371 (c)(1),
(2) Date: Jul. 23, 2021

(87) PCT Pub. No.: WO2020/153806
PCT Pub. Date: Jul. 30, 2020

(65) Prior Publication Data

US 2022/0097947 A1 Mar. 31, 2022

(30) Foreign Application Priority Data

Jan. 25, 2019 (KR) ..... 10-2019-0010072

(51) Int. Cl.
*B65D 81/34* (2006.01)
*B65D 1/36* (2006.01)
(Continued)

(52) U.S. Cl.
CPC ..... *B65D 81/3446* (2013.01); *B65D 1/36* (2013.01); *B65D 51/1622* (2013.01);
(Continued)

(58) Field of Classification Search
CPC .. B65D 81/3446; B65D 1/36; B65D 51/1622; B65D 51/1638; B65D 71/40; B65D 77/2006; B65D 77/2048
See application file for complete search history.

(56) References Cited

U.S. PATENT DOCUMENTS 3,539,071 A * 11/1970 Ludder ..... B65D 57/003 206/520
3,654,076 A * 4/1972 Hatch ..... B65D 1/34 206/520
(Continued)

FOREIGN PATENT DOCUMENTS

CN 104943993 9/2015
CN 104943993 A 9/2015
(Continued)

OTHER PUBLICATIONS

Chinese Office Action for Application No. 202080010726.7 dated May 24, 2022, citing the above reference(s).
(Continued)

*Primary Examiner* — Viren A Thakur
*Assistant Examiner* — Chaim A Smith
(74) *Attorney, Agent, or Firm* — CANTOR COLBURN LLP

(57) ABSTRACT

The present disclosure relates to a container for retort food and, more specifically, to a container for retort food, which includes: a ridge portion having a closed curve shape to surround a tray part; and an exhaust hole surrounded by the ridge portion, so that the container enables a lid film to be automatically peeled off from the ridge portion by means of a steam pressure generated in a food during heating to exhaust steam and can be used for retort food which is stored at room temperature.

4 Claims, 5 Drawing Sheets

(51) Int. Cl.
*B65D 51/16* (2006.01)
*B65D 71/40* (2006.01)
*B65D 77/20* (2006.01)

(52) U.S. Cl.
CPC ..... *B65D 51/1638* (2013.01); *B65D 71/40* (2013.01); *B65D 77/2004* (2013.01); *B65D 77/2048* (2013.01)

(56) References Cited

U.S. PATENT DOCUMENTS

| | | | | |
|---|---|---|---|---|
| 4,834,247 | A | 5/1989 | Oshima et al. | |
| 10,233,009 | B2 | 3/2019 | Ishikawa et al. | |
| 2009/0110785 | A1* | 4/2009 | Yasumuro ..... | B65D 77/225 426/107 |
| 2017/0073145 | A1* | 3/2017 | Ishikawa ..... | B65D 81/3453 |

FOREIGN PATENT DOCUMENTS

| | | | |
|---|---|---|---|
| CN | 207890351 | U | 9/2018 |
| JP | H0222728 | U | 2/1990 |
| JP | 1995033174 | | 2/1995 |
| JP | 2000281107 | | 10/2000 |
| JP | 2004059048 | | 2/2004 |
| JP | 2007045488 | | 2/2007 |
| JP | 3144711 | | 9/2008 |
| JP | 3157394 | U | 2/2010 |
| JP | 4924613 | B2 | 4/2012 |
| JP | 2013047103 | A | 3/2013 |
| JP | 2015196520 | | 11/2015 |
| JP | 2016069005 | | 5/2016 |
| JP | 2017119522 | A | 7/2017 |
| KR | 1020030085281 | A | 6/2005 |
| KR | 1020090081378 | | 7/2009 |
| KR | 2020100005586 | | 6/2010 |
| KR | 101536268 | | 7/2015 |
| KR | 2020180003054 | | 10/2018 |
| KR | 1020190010072 | | 1/2019 |
| KR | 10-1982212 | B1 | 8/2019 |
| WO | 2008/056690 | A1 | 5/2008 |
| WO | 2012053734 | A1 | 4/2012 |

OTHER PUBLICATIONS

International Search Report—PCT/KR2020/001210 dated May 7, 2020, cited references listed within.
The Extended European Search Report for Application No./Patent No. 20745834.0-1014 / 3915899 PCT/KR2020001210; Date of Completion: Sep. 7, 2022; 7 pages.

* cited by examiner

CONTAINER FOR RETORT FOOD

TECHNICAL FIELD

The present disclosure relates to a container for retort food and, more specifically, to a container for retort food, which includes: a ridge portion having a closed curve shape to surround a tray part; and an exhaust hole surrounded by the ridge portion, so that the container enables a lid film to be automatically peeled off from the ridge portion by means of a steam pressure generated in a food during heating to exhaust steam and can be used for retort food which is stored at room temperature.

BACKGROUND ART

Recently, containers for retort food have been developed, which have a packaging form in which a steam discharge function is automatically implemented even when the food is cooked in a microwave oven without detaching or taking off a lid film prior to the cooking. Such a container for retort food is mainly intended for refrigerated and frozen products, and it is sufficient to have a packaging form that operates a steam discharge function when the food is cooked in a microwave oven.

However, with regard to retort products at room temperature, the products have to be sterilized so as to be distributed at room temperature, and thus, a sterilization process, in which the retort products are sealed and then exposed to high temperature heat for a considerable period of time, has to be performed. In general, since a refrigerated or frozen retort container having a steam discharge function does not have a structure made by assuming that a sterilization process is performed thereon, the steam discharge function is operated during the sterilization process, and accordingly, sealing is broken before the product is distributed. Thus, there is a need to develop a special refrigerated retort container in which a steam discharge structure is not broken at retort sterilization conditions (high temperature, high pressure) and operated only when cooking is performed in a microwave oven.

Furthermore, with regard to a container for a refrigerated or frozen retort food having an automatic steam discharge function according to the related art, a discharge means for conducting discharge is located biased toward one side of the container, and thus, steam is not discharged uniformly, and the texture of food is deteriorated.

DESCRIPTION OF EMBODIMENTS

Technical Problem

Provide is a container for retort food, which includes: a ridge portion having a closed curve shape to surround a tray part; and an exhaust hole surrounded by the ridge portion, so that the container enables a lid film to be automatically peeled off from the ridge portion by means of a steam pressure generated in a food during heating to exhaust steam and can be used for retort food which is stored at room temperature.

Solution to Problem

According to an aspect of the present disclosure, a container for retort food includes: a tray part which has a predetermined area and a depth recessed in a downward direction and has a space open in an upward direction; and a flange part which constitutes a periphery of an upper end of the tray part, wherein the flange part includes an outer flange area which constitutes an outer circumference of the container for retort food and an inner flange area which divides the tray part across the container for retort food, wherein the flange part includes: a ridge portion which is formed on the flange part, has a closed curve shape to surround the tray part, and protrudes in the upward direction; and an exhaust hole which vertically passes through at least a portion of the flange part, wherein the ridge portion includes an inner ridge formed on the inner flange area and an outer ridge formed on the outer flange area and branching from the inner ridge, wherein the exhaust hole is located in the inner flange area, the inner ridge has a branch ridge having a closed curve shape that branches with the exhaust hole therebetween and then joins, and the exhaust hole is located within the closed curve formed by the branch ridge.

According to an example, the branch ridge has a first branch line and a second branch line which branch with the exhaust hole therebetween and are spaced apart from each other in a horizontal direction, and at least one of the first branch line and the second branch line has a first tip end sharply protruding toward the tray part adjacent thereto.

According to an example, horizontal widths of the first branch line and the second branch line are less than widths of the other regions of the ridge portion.

According to an example, the inner ridge includes an intermediate ridge which connects the branch ridge and the outer ridge, wherein a radius of curvature of the intermediate ridge is greater than a radius of curvature of the outer ridge.

According to an example, the flange part includes a handle part, at least a portion of which extends outward in a radial direction of the container for retort food, wherein the ridge portion includes a second tip end which is located on the handle part and protrudes in an outward direction of the container for retort food.

According to an example, the tray part has a stacking stepped portion on the outer surface thereof.

Advantageous Effects of Disclosure

A container for retort food according to the present disclosure is provided with an exhaust hole surrounded by a ridge portion. Thus, when a lid film is peeled off from the ridge portion by means of a steam pressure generated in a food during heating, the steam may be discharged through the exhaust hole. Thus, a user does not need to peel off the lid film before the food is heated.

Furthermore, in the container for retort food according to the present disclosure, the exhaust hole is located in the vicinity of a central region of thereof. Thus, since the steam pressure is intensively applied to the ridge portion around the exhaust hole when the food is heated, the lid film around the exhaust hole may be peeled off earlier.

Also, since the exhaust hole is located in the vicinity of the central region of the container for retort food, steam generated in each of trays may be exhausted relatively uniformly. Thus, the quality of heated food may be improved. Moreover, when a user holds a handle part located on the outside of the heated container for retort food, the user is less likely to feel hot or get burned.

Also, since the steam is discharged through the exhaust hole having a relatively small size, moisture and pressure within the container is maintained relatively high, and thus, cooking for a steamed dish may be performed. Thus, the texture of heated food may be further improved.

In particular, the ridge portion in the container for retort food according to the present disclosure has a closed curve shape that surrounds each of the trays. Thus, the food stored in each of the trays may be individually sealed, and the stored foods may be prevented from being mixed with each other. Thus, it may be used for retort food stored at room temperature in addition to a frozen food.

BEST MODE

According to an aspect of the present disclosure, a container for retort food includes: a tray part which has a predetermined area and a depth recessed in a downward direction and has a space open in an upward direction; and a flange part which constitutes a periphery of an upper end of the tray part, wherein the flange part includes an outer flange area which constitutes an outer circumference of the container for retort food and an inner flange area which divides the tray part across the container for retort food, wherein the flange part includes: a ridge portion which is formed on the flange part, has a closed curve shape to surround the tray part, and protrudes in the upward direction; and an exhaust hole which vertically passes through at least a portion of the flange part, wherein the ridge portion includes an inner ridge formed on the inner flange area and an outer ridge formed on the outer flange area and branching from the inner ridge, wherein the exhaust hole is located in the inner flange area, the inner ridge has a branch ridge having a closed curve shape that branches with the exhaust hole therebetween and then joins, and the exhaust hole is located within the closed curve formed by the branch ridge.

Mode of Disclosure

Hereinafter, preferred examples according to the present disclosure will be described with reference to the accompanying drawings.

Figure 1:
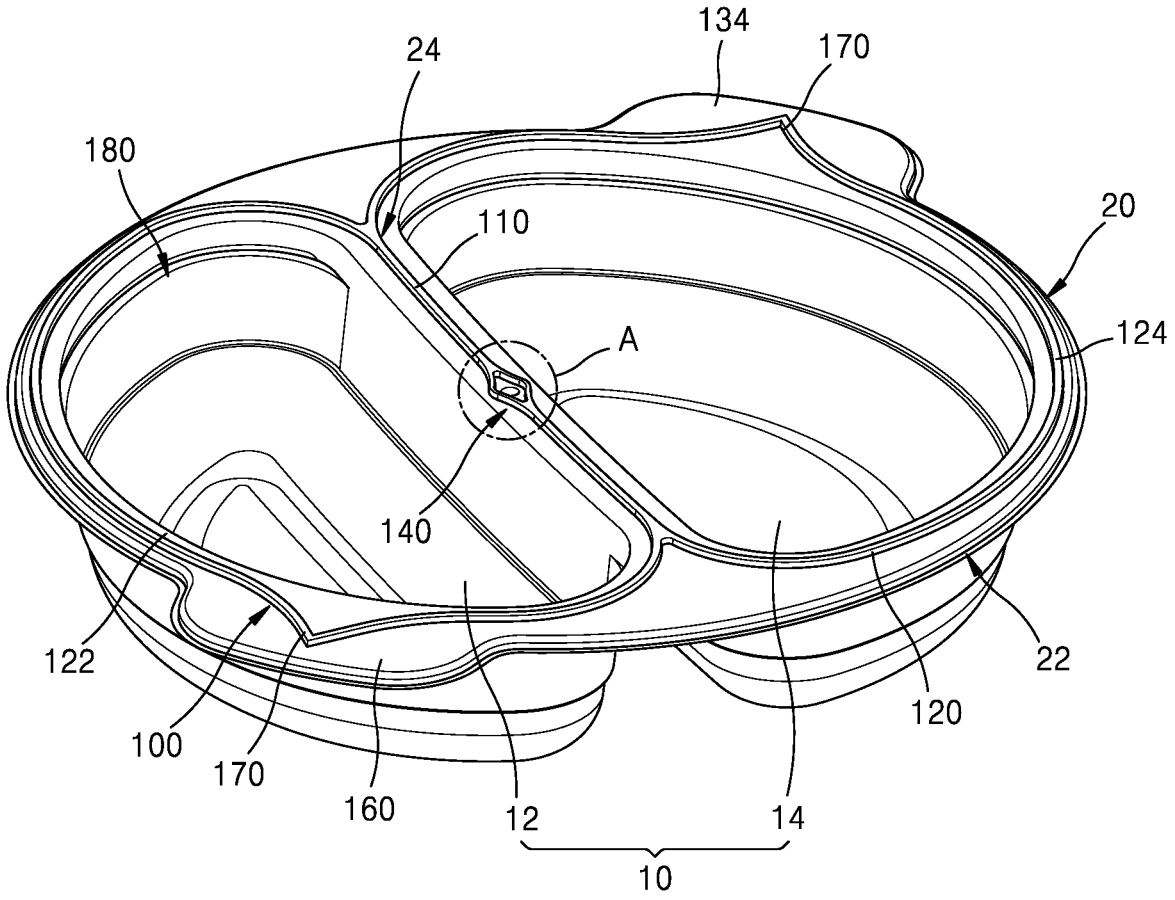
FIGS. 1 and 2 show the overall structure of a container for retort food according to the present disclosure when viewed from the top and bottom.
Figure 2:
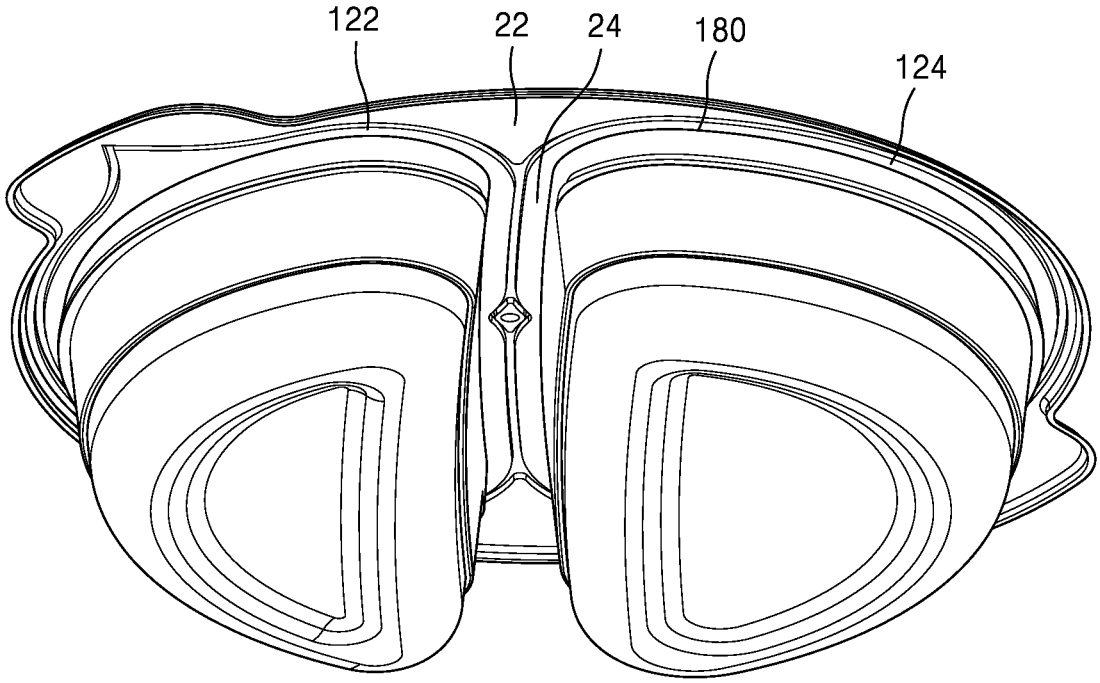
Figure 3:
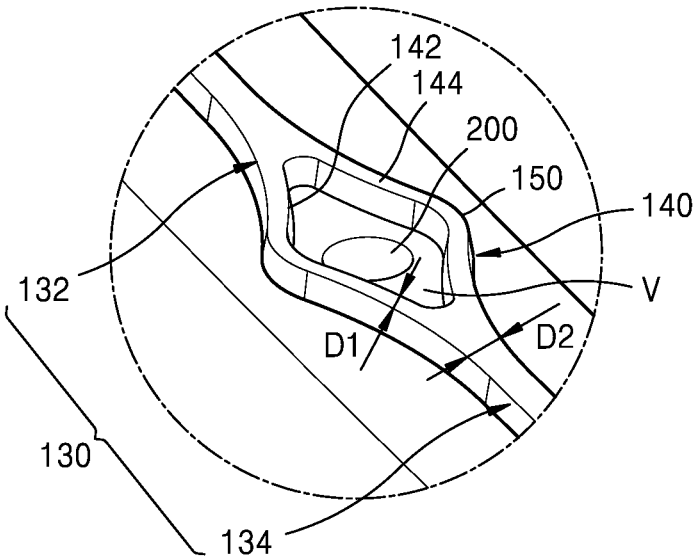
FIG. 3 is an enlarged view showing a region A of FIG. 1.
Figure 4:
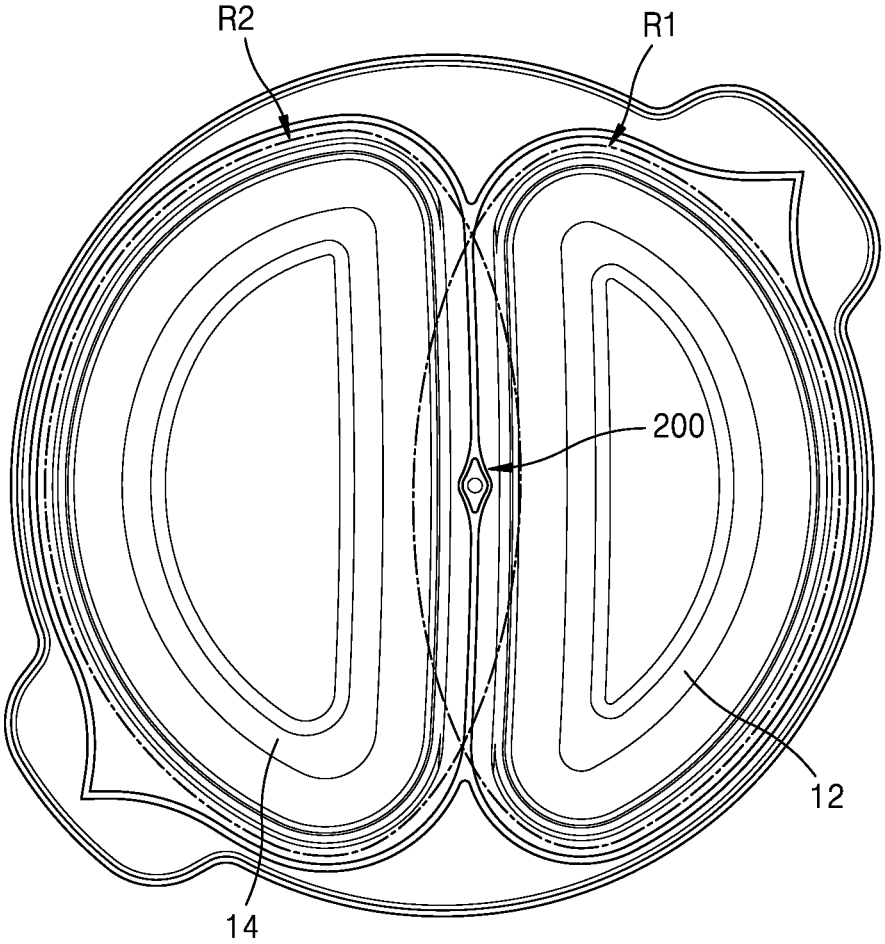
FIG. 4 is a view conceptually showing a shape of a tray part in the container for retort food according to the present disclosure.
Figure 5:
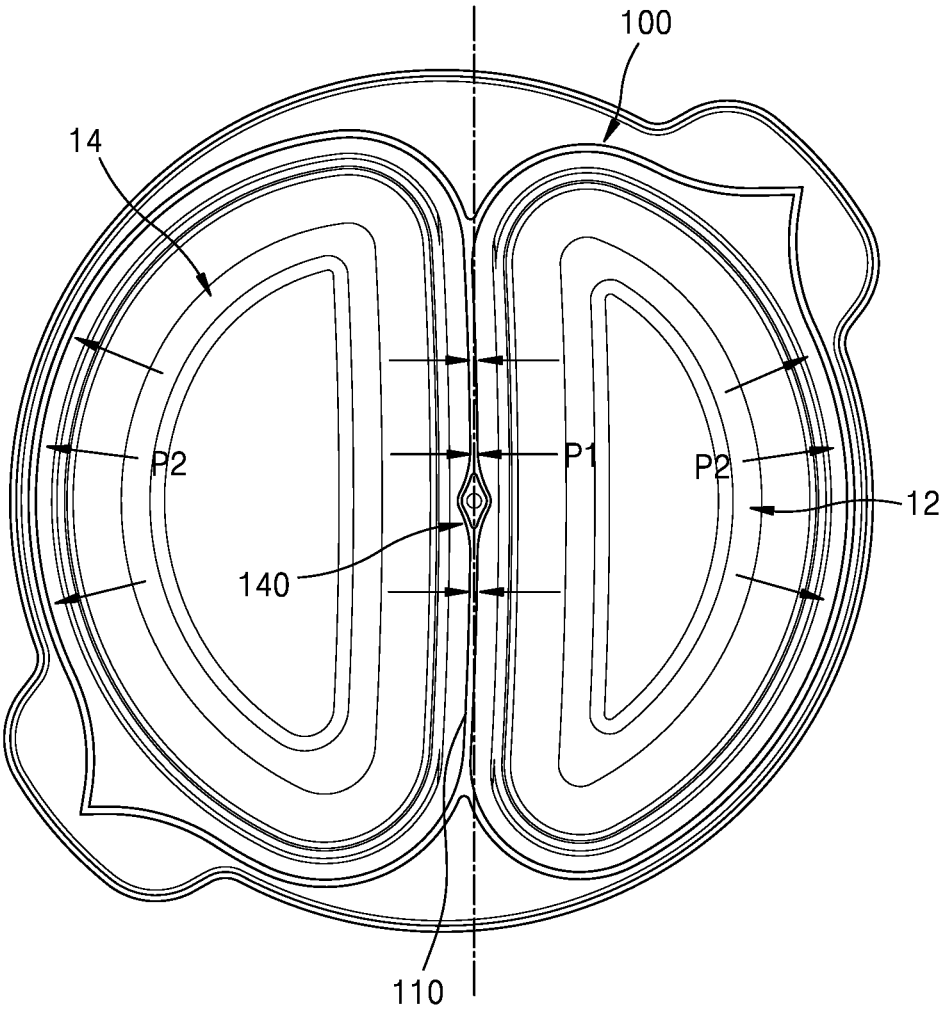
FIG. 5 is a view conceptually showing a steam pressure applied to the tray part in the container for retort food according to the present disclosure.

FIGS. 1 and 2 show the overall structure of a container for retort food according to the present disclosure when viewed from the top and bottom, and FIG. 3 is an enlarged view showing a region A of FIG. 1. Also, FIG. 4 is a view conceptually showing a shape of a tray part 10 in the container for retort food according to the present disclosure, and FIG. 5 is a view conceptually showing a steam pressure applied to the tray part 10 in the container for retort food according to the present disclosure.

The container for retort food according to the present disclosure is configured to include: a tray part 10 which has a predetermined area and a depth recessed in a downward direction and has a space open in an upward direction; and a flange part 20 which constitutes a periphery of an upper end of the tray part 10.

The tray part 10 has a predetermined area, and is recessed in the downward direction and has a predetermined depth. The space inside the tray part 10 substantially constitutes a food input and storage space.

The tray part 10 may have a generally circular shape and may be divided into a plurality of segments by an inner flange area 24 of the flange part 20, which will be described later. Accordingly, the tray part 10 may include a first tray 12 and a second tray 14. The first tray 12 and the second tray 14 may have arbitrary shapes, areas, and volumes. According to one example, preferably, the inner flange area 24 crosses the vicinity of the central region of the container for retort food as described above, and thus, the first tray 12 and the second tray 14 may have relatively similar areas and volumes. Also, the shape of each of the first tray 12 and the second tray 14 may have a shape close to a half circle.

The flange part 20 constitutes a peripheral region of the upper end of the tray part 10.

The flange part 20 may include an outer flange area 22 and an inner flange area 24.

The outer flange area 22 may be a portion that constitutes an outer circumference of the container for retort food. As a result, the outer flange area 22 may form an appearance in the planar direction of the container for retort food. Preferably, the outer flange area 22 may have a generally circular ring shape.

The inner flange area 24 may be a portion that divides the tray part 10 across the container for retort food. For example, the inner flange area 24 may extend to cross the container for retort food approximately in the diameter direction. Thus, both ends of the inner flange area 24 may constitute a continuation with the inside of the outer flange area 22. Preferably, the inner flange area 24 may have a straight line section or a curved line section having a relatively large curvature.

The tray part 10 is divided into a plurality of tray elements independent from each other by the inner flange area 24. That is, the tray part 10 may be divided into the first tray 12 and the second tray 14 with the inner flange area 24 therebetween. Also, the inner flange area 24 and at least a portion of the outer flange area 22 are merged with each other to form one closed curve, and the closed curve may surround the first tray 12 and the second tray 14.

Obviously, it is not limited thereto, and the number of a plurality of trays constituting the tray part 10 may be an arbitrary value. Also, the inner flange area 24 may be provided as a plurality of segments or have a plurality of branches.

A ridge portion 100 and an exhaust hole 200 may be formed in the flange part 20.

The ridge portion 100 is formed on the flange part 20, and is a component which is formed along the flange part 20, has a closed curve shape to surround the tray part 10, and protrudes a predetermined height in the upward direction. For example, as illustrated in FIG. 2, the ridge portion 100 may be configured by a recess which is formed to be recessed from the bottom surface of the flange part 20 in the upward direction so that a portion of the flange part 20 protrudes in the upward direction.

When a lid film is attached to the container for retort food according to the present disclosure, the lid film may be attached to the ridge portion 100. That is, an upper end of the ridge portion 100 may function as an attachment surface to which the lid film is attached (thermally fused).

The exhaust hole 200 may be a predetermined hole that vertically passes through at least a portion of the flange part 20. The exhaust hole 200 may be located in the inner flange area 24. Preferably, the exhaust hole 200 may be formed at a central position of the container for retort food.

Hereinafter, specific embodiments and effects of the ridge portion 100 will be described in more detail.

The ridge portion 100 may include an inner ridge 110 formed in the inner flange area 24 and an outer ridge 120 formed in the outer flange area 22 and branching from the inner ridge 110. Here, the inner ridge 110 and the outer ridge 120 have a concept indicating a portion of the ridge portion 100.

The inner ridge 110 is formed on the inner flange area 24 and may have a straight line or curved line shape as extending along the inner flange area 24.

The outer ridge 120 is formed on the outer flange area 22 and extends along the outer flange area 22. Thus, the outer ridge 120 may have a generally circular shape corresponding to the entire appearance of the container for retort food.

The outer ridge 120 may branch from the inner ridge 110 into a plurality of segments. In other words, the inner ridge 110 may be understood as the place where two or more outer ridges 120 join.

That is, when one inner flange area 24 is provided and the tray part 10 is divided into the first tray 12 and the second tray 14 with the inner flange area 24 therebetween, one inner ridge 110 is provided on the inner flange area 24, and the outer ridge 120 may branch from the one inner ridge 110. Thus, the outer ridge 120 may include a first outer ridge 122 located on the outside of the first tray 12 and a second outer ridge 124 located on the outside of the second tray 14.

The inner ridge 110 includes an intermediate ridge 130 connected to the outer ridge 120 and a branch ridge 140 located in the inside of the inner ridge 110 and connected to the intermediate ridge 130. The branch ridge 140 and the intermediate ridge 130 have a concept indicating a portion of the inner ridge 110.

The intermediate ridge 130 is a portion which constitutes a portion of the inner ridge 110, and has one end connected to the outer ridge 120 and the other end connected to the branch ridge 140. As described later, the branch ridge 140 is located at a middle position of the inner ridge 110, and thus, the intermediate ridge 130 is provided on each of both sides of the branch ridge 140. Thus, the intermediate ridge 130 may include a first intermediate line 132 and a second intermediate line 134 which are disposed with the branch ridge 140 therebetween and are located at the respective sides of the branch ridge 140.

A radius of curvature of the intermediate ridge 130 may be configured to be greater than a radius of curvature of the outer ridge 120. Preferably, the intermediate ridge 130 may have a straight line shape or a shape close to a straight line.

The branch ridge 140 is located in a peripheral region of the exhaust hole 200. Thus, the branch ridge 140 is located in a middle region of the inner ridge 110. The branch ridge 140 may have a branch structure which branches at one end into two or more segments and joins at the other end. Here, the exhaust hole 200 may be located in a space between branches of the branch ridge 140.

Particularly, the branch ridge 140 may have a first branch line 142 and a second branch line 144. The first branch line 142 and the second branch line 144 branch from an end of the intermediate ridge 130 and are spaced predetermined distances from each other in the horizontal direction, and then may join at an end of the intermediate ridge 130.

Describing this configuration along a direction of an arrow of FIG. 3, each of the first branch line 142 and the second branch line 144 extends after branching at a rear end of the first intermediate line 132, and then, when the first branch line 142 and the second branch line 144 arrive at a front end of the second intermediate line 134, the first branch line 142 and the second branch line 144 may join and be connected to the second intermediate line 134.

The exhaust hole 200 may be located in a space V between the first branch line 142 and the second branch line 144. That is, the exhaust hole 200 is surrounded by the branch lines, the branch ridge 140 forms a closed curve surrounding the exhaust hole 200, and the exhaust hole 200 is located in the space V within the closed curve.

Hereinafter, the effects of the present disclosure will be described.

For example, when heating is performed without peeling off a lid film in a container for retort food according to the related art, the lid film bursts or peels at an arbitrary position due to a steam pressure generated in heated food. This occurs typically due to the high-pressure steam pressure, and open positions are also irregular while generating noises such as explosion sound.

Furthermore, when heating is performed after peeling off one side region of the lid film, the steam escapes intensively through this region, and thus, moisture in a portion of the food adjacent to this region is lost, which causes deterioration in texture. That is, the moisture in a portion of the food escapes excessively, and the food becomes hard. Moreover, when a user grips the heated container for retort food with a hand, if the user's hand is located close to the position where the steam is exhausted, the user gets burns on the hand or feels hot due to the exhaust of steam. In particular, when the lid film in a peripheral region of a handle becomes peeled off, as the high-temperature steam escaping through the peeled region is transferred to the user who grips the handle, the user gets burns on the hand, or there is inconvenience that the user may not use the handle.

However, the container for retort food according to the present disclosure is provided with the exhaust hole 200 surrounded by the ridge portion 100. Thus, when the lid film is peeled off from the ridge portion 100 by means of a steam pressure generated in a food during heating, the steam may be discharged through the exhaust hole 200. Thus, a user does not need to peel off the lid film before the food is heated.

Furthermore, the exhaust hole 200 is located at the central region of the container for retort food according to the present disclosure, and since the steam pressure is intensively applied to the ridge portion 100 around the exhaust hole 200 when the food is heated, the lid film around the exhaust hole 200 may be peeled off earlier. Thus, it is possible to prevent the lid film from being peeled off earlier from an unintended region.

Also, since the exhaust hole 200 is located in the vicinity of the central region of the container for retort food, steam generated in each of trays may be exhausted relatively uniformly. Furthermore, in a steam discharge process, the steam passes through the exhaust hole 200 formed in the flange part 20 while staying in all regions around the exhaust hole 200, and then, the steam is exhausted downward. Thus, during the exhaust process, moisture of the food located around the exhaust hole 200 is not excessively eliminated. Thus, the quality of heated food may be improved.

Also, the position of the exhaust hole 200 is located around the central region of the container for retort food, a handle part 160 is located relatively far away from the steam exhaust position, and the discharge direction through the exhaust hole 200 is also the downward direction, and thus, when a user holds the handle part 160 of the heated container for retort food, the user is less likely to feel hot or get burned.

Also, since the steam is discharged through the exhaust hole 200 having a relatively small size, moisture and pressure within the container is maintained relatively high, and thus, cooking for a steamed dish may be performed. Thus, the texture of heated food may be further improved.

Also, preferably, since the tray part 10 has a generally circular shape, it is possible to prevent the steam pressure from being intensively applied to a specific outer region. Thus, it is possible to prevent the lid film from being unintentionally peeled off during the heating.

The structure of the exhaust hole 200 surrounded by the branch ridge 140, the configuration in which the position of the exhaust hole 200 is located at the central region of the container for retort food, and the structure of the ridge portion 100 surrounding the tray part 10 in the closed curve shape may provide following effects. First, the lid film of the container for retort food according to the present disclosure may not be easily peeled off under sterilization conditions (for example, the retort food is exposed to pressurized heat at 70 to 120° C. for 30 minute to 120 minutes). Also, even when heated by a MW, only the lid film on the branch ridge 140 in the central region of the container for retort food may be peeled off, but the lid film on the outer ridge 120 and the inner ridge 110 may not be peeled off. Thus, a function appropriate for a room temperature retort container may be implemented.

Moreover, the lid film in the mid-region of the container for retort food is peeled earlier, and thus, when peeling off the lid film, a user may detach and peel off instantly while holding one side portion thereof. Thus, the user's convenience may be enhanced.

In particular, the ridge portion 100 in the container for retort food according to the present disclosure has a closed curve shape that surrounds each of the trays. Thus, the food stored in each of the trays may be individually sealed, and the stored foods may be prevented from being mixed with each other. Thus, it may be used for retort food stored at room temperature in addition to a frozen food.

The effects of the container for retort food according to the present disclosure described above have been confirmed through an experiment performed under actual mass-production conditions. For example, when a retort food sterilization process was performed after a container for retort food, in which the shape according to FIG. 1 is reflected, was filled with a food and sealed with a lid film, the lid film including a mid-lid film was not peeled off at all. Also, when cooked for a suitable time (2 minutes) in a commercialized microwave oven, only the lid film located in the middle region of the container for retort food was peeled off, and a steam discharge function was operated.

Hereinafter, each of detailed embodiments of the present disclosure and the effects thereby will be described.

According to a preferred embodiment, at least one of the first branch line 142 and the second branch line 144 may have a first tip end 150 sharply protruding toward the tray part 10 adjacent thereto. Here, the meaning of protruding sharply is not necessarily limited to the meaning that slopes of tangent lines to the ridge portion 100 have discontinuity. That is, according to one example, the case having a configuration, in which the magnitudes of the slopes of the tangent lines are continuous but change relatively rapidly compared to other regions, may also be included in the first tip end 150.

Thus, when a steam pressure is applied to the first branch line 142 or the second branch line 144, the steam pressure may be intensively applied to the first tip end 150. Thus, the lid film located in the first tip end 150 may be peeled off from the ridge portion 100 earlier.

Moreover, according to a preferred embodiment, the horizontal widths of the first branch line 142 and the second branch line 144 may be less than widths of the other regions of the ridge portion 100. For example, as illustrated in FIG. 3, a width D1 of each of the first branch line 142 and the second branch line 144 may be less than a width D2 of the intermediate ridge 130. Thus, the attachment widths of the lid film attached on the first branch line 142 and the second branch line 144 may be less than the attachment widths of the lid film attached on the other regions of the ridge portion 100.

Moreover, according to a preferred embodiment, the radius of curvature of the intermediate ridge 130 may be configured to be greater than the radius of curvature of the outer ridge 120. Preferably, the intermediate ridge 130 may have a straight line shape or a shape close to a straight line. As a result, the regions of the inner ridge 110 may be subjected to a greater steam pressure than the regions of the circular outer ridge 120.

For example, when the shape of the tray part 10 is understood as a virtual elliptical form and illustrated, R1 and R2 are illustrated as in FIG. 4. Thus, the inner ridge 110 is located in a space where the virtual ellipses constituting the tray part 10 overlap each other. Thus, the inner ridge 110 may be simultaneously subjected to the overlapped steam pressures which are applied from the tray part 10 on both sides. Thus, a steam pressure P1 applied to the inner ridge 110 may be greater than a steam pressure P2 applied to the outer ridge 120. Moreover, the regions of the branch ridge 140 having the protruding three-dimensional structure may be intensively subjected to the steam pressure. That is, the branch ridge 140 may be subjected to the steam pressure more intensively than not only the outer ridge 120 but also the other regions of the inner ridge 110.

Thus, the lid film attached on the region of the branch ridge 140 may be peeled off earlier than the lid film attached on the other regions. That is, as described above, the configuration about the first tip end 150, the configuration about the width of the branch line, and the configuration about the branch ridge 140 located between the intermediate ridge 130 having the larger radius of curvature may prevent the lid film from being unintentionally peeled off from the other regions of the ridge portion 100 earlier. Thus, exhaust effects by the exhaust hole 200 may be stably achieved.

According to a preferred embodiment, the flange part 20 may include the handle part 160, at least a portion of which extends outward in a radial direction of the container for retort food. Preferably, the handle part 160 may be also provided on the opposite side in the radial direction of the container for retort food so that a user may easily hold the container for retort food with two hands. Also, preferably, the handle part 160 may be located at a position spaced a predetermined distance from a horizontal line that crosses the inner flange area 24.

As the handle part 160 is provided, a user may easily hold, move, and use the container for retort food according to the present disclosure.

Also, according to a preferred embodiment, the ridge portion 100 has a second tip end 170 which is located on the handle part 160 and protrudes in an outward direction of the container for retort food. The second tip end 170 has a shape protruding outward from the outer ridge 120 in a radial direction. Thus, the second tip end 170 may be located at a position which is further away from the exhaust hole 200 than the other regions of the outer ridge 120.

As the second tip end 170 is provided, a user may easily peel off the lid film after the food is heated. Also, the second tip end 170 protrudes in an outer diameter direction of the container for retort food compared to the other regions and is thus subjected to relatively little steam pressure during a heating process. Thus, it is possible to prevent the lid film located on the handle part 160 from being unintentionally peeled off. If the lid film on the handle part 160 has been peeled off, steam is discharged through the corresponding region, and thus, a user is likely to feel hot or get burned when holding the handle part 160. However, such a limitation may be prevented because the present disclosure has the second tip end 170 described above to prevent the lid film on the handle part 160 from unintentionally being peeled off. Furthermore, since the middle region of the lid film is peeled off earlier during a heating process by a microwave oven as described above, the entire lid film may be peeled off instantly by using the second tip end 170 on one side.

According to a preferred embodiment, a stacking stepped portion 180 may be formed in the outer circumferential surface of the tray part 10. Thus, when the container for retort food according to the present disclosure is stacked, the stacking may be easily performed.

Although the preferred examples have been illustrated and described, the present disclosure is not limited to the specific examples described above, and it is obvious that various modifications may be made by those skilled in the art to which the present disclosure pertains without departing from the subject matter of the present disclosure as set forth in the claims, and it is to be noted that those modifications should not be understood separately from the technical concept and prospect of the present disclosure.

The invention claimed is:

1. A container for retort food, the container comprising:

a tray part which has a predetermined area and a depth recessed in a downward direction and has a space open in an upward direction; and a flange part which constitutes a periphery of an upper end of the tray part, wherein the flange part comprises an outer flange area which constitutes an outer circumference of the container for retort food and an inner flange area which divides the tray part across the container for retort food, wherein the flange part comprises:

a ridge portion which is formed on the flange part, has a closed curve shape to surround the tray part, and protrudes in the upward direction; and an exhaust hole which vertically passes through at least a portion of the flange part, wherein the ridge portion comprises an inner ridge formed on the inner flange area and an outer ridge formed on the outer flange area and branching from the inner ridge, wherein the exhaust hole is located in the inner flange area, the inner ridge has a branch ridge having a closed curve shape that branches with the exhaust hole therebetween, and the exhaust hole is located within the closed curve shape formed by the branch ridge and an intermediate ridge which connects the branch ridge and the outer ridge, wherein the intermediate ridge comprises a first intermediate line and a second intermediate line which are disposed with the branch ridge therebetween and are respectively located on opposing sides of the branch ridge, and the branch ridge comprises a first branch line and a second branch line which are spaced apart from each other in a horizontal direction, wherein the first branch line and the second branch line have one end connected to an end of the first intermediate line and the other end connected to an end of the second intermediate line, the first branch line and the second branch line form a closed curve shape and the exhaust hole is located in the closed curve shape, and at least one of the first branch line and the second branch line comprises a first tip end protruding toward the tray part, wherein a radius of curvature of the intermediate ridge is greater than a radius of curvature of the outer ridge.

2. The container for retort food of claim 1, wherein horizontal widths of the first branch line and the second branch line are less than widths of the inner ridge formed on the inner flange area and the outer ridge formed on the outer flange area.

3. The container for retort food of claim 1, wherein the flange part comprises a handle part, at least a portion of the handle part extends outward in a radial direction of the container for retort food, wherein the ridge portion comprises a second tip end which is located on the handle part and protrudes in an outward direction of the container for retort food.

4. The container for retort food of claim 1, wherein the tray part has a stacking stepped portion on an outer surface of the tray.

* * * * *